United States Patent [19]

Sheffler

[11] Patent Number: 4,569,438

[45] Date of Patent: Feb. 11, 1986

[54] CONTAINER HAVING FLUID-TIGHT SEAL

[75] Inventor: Robert J. Sheffler, Morganville, N.J.

[73] Assignee: Revlon, Inc., New York, N.Y.

[21] Appl. No.: 697,993

[22] Filed: Feb. 4, 1985

[51] Int. Cl.[4] ..... A45D 33/00

[52] U.S. Cl. ..... 206/37; 206/235; 132/83 R

[58] Field of Search ..... 206/37, 38, 235; 132/83 R

[56] References Cited

U.S. PATENT DOCUMENTS

| | | | |
|---|---|---|---|
| 1,534,872 | 4/1925 | Roystone . | |
| 1,602,243 | 10/1926 | Nobel et al. . | |
| 1,686,973 | 10/1928 | Kendall . | |
| 1,690,403 | 11/1928 | Coryell | 132/83 R |
| 1,930,532 | 10/1933 | Mitchell . | |
| 1,968,177 | 7/1934 | Shepherd, et al. . | |
| 1,987,533 | 1/1935 | Kreisler | 132/83 R |
| 2,033,295 | 3/1936 | Parkin . | |
| 2,035,832 | 3/1936 | Parkin . | |
| 2,054,004 | 9/1936 | Sandberg . | |
| 2,124,300 | 7/1938 | Houlihan . | |
| 2,137,886 | 11/1938 | Zell | 132/83 R |
| 2,179,669 | 10/1939 | Parkin . | |
| 2,215,480 | 9/1940 | Sampson | 132/83 R |
| 2,288,892 | 7/1942 | Dukehart, Jr. . | |
| 2,366,009 | 12/1944 | de Pasquale et al. | 206/37 R |
| 2,465,491 | 3/1949 | Storch | 132/83 R |
| 2,737,189 | 3/1956 | Morningstar et al. | 132/83 R |
| 4,018,237 | 4/1977 | Steiman | 132/83 R |
| 4,337,859 | 7/1982 | Murphy et al. | 206/37 |

FOREIGN PATENT DOCUMENTS

| | | | |
|---|---|---|---|
| 1004534 | 9/1965 | United Kingdom | 132/83 R |

*Primary Examiner*—William T. Dixson, Jr.
*Assistant Examiner*—Brenda J. Ehrhardt

[57] ABSTRACT

A container for storing and dispensing products is disclosed which features a substantially fluid-tight seal for preventing or inhibiting the loss of any volatile component(s) contained in the product and/or for preventing air, water vapor, microorganisms or other agents which might adversely affect the product from freely coming into contact therewith. The container of this invention is especially adapted for storing and dispensing a solid or semi-solid cosmetic product containing at least one component which is relatively volatile and/or susceptible to chemical and/or microbial spoilage and comprises:

(a) a base member provided with a chamber for storing product;

(b) a cover member; and, (c) a laterally compressible sealing means disposed between a downwardly projecting rigid element associated with or forming part of the cover member and an upwardly projecting rigid element associated with or forming part of the base member or chamber, the sealing means extending continuously about the chamber such that when the base member is in closing engagement with the cover member, the downwardly and upwardly projecting rigid elements cooperate to subject the sealing means disposed therebetween to a substantially fluid-tight lateral compression.

6 Claims, 4 Drawing Figures

CONTAINER HAVING FLUID-TIGHT SEAL

BACKGROUND OF THE INVENTION

This invention relates to the field of containers and, more particularly, to containers for storing and dispensing solid and semi-solid products, generally of a cosmetic nature, which contain one or more volatile components.

Containers for storing and dispensing numerous kinds of solid and semi-solid cosmetic products such as ointments, gels, pomades, loose or pressed powders, and the like, and optionally provided with devices which facilitate use of the contents, e.g., applicators, mirrors, etc., are well known. These and similar cosmetic products typically contain one, and usually several, relatively volatile components which can be given off, and consequently lost, by the products in amounts which will vary depending upon temperature and humidity conditions and the effectiveness of any sealing device which the container might feature. For example, such common cosmetic ingredients as fragrances, essential oils, organic liquids, water, and the like, can readily volatilize, especially in warm, dry-climate conditions, causing undesirable changes in the physical appearance and consistency of the host product even to the point where the product may be rendered unfit for use. In addition, exposure of cosmetic products to freely circulating atmospheric oxygen, humidity and in some cases, air borne microorganisms, can result in premature degradation of the products by a variety of chemical and biological mechanisms.

Accordingly, it has long been desirable to provide containers which substantially prevent or inhibit loss of volatiles from solid or semi-solid products containing same and, moreover, which limit the opportunity of extraneous substances such as oxygen, water vapor, microorganisms, and the like, from coming into contact with, and degrading, the products.

Illustrative of known types of containers for cosmetic products are the vanity cases of U.S. Pat. Nos. 1,534,872; 1,603,243; 1,686,973; 1,930,532; 2,033,295; 2,035,832; 2,054,004; 2,124,300; 2,179,669; and, the powder boxes or containers of U.S. Pat. Nos. 1,968,177 and 2,288,892. Each of the containers described in these patents is provided with a base member for storing a quantity of cosmetic product, sometimes in a separately defined chamber or reservoir associated with or part of the base member; a cover or lid member, frequently attached to the base member by means of a hinge; locking means, e.g., a latch or clasp, to maintain the container in the sealed condition; and, in some cases, a compressible element to provide a still more effective seal (as in aforesaid U.S. Pat. No. 2,033,295).

However, the seals which can be obtained with these arrangements are not entirely fluid-tight and small, but significant quantities of volatiles can still escape form the stored cosmetic product adversely affecting its quality. In addition, potentially harmful substances such as air, water vapor and/or microorganisms can penetrate the inefficient seals of these and similar containers posing yet further risks to the quality and integrity of the stored cosmetic product. In those containers featuring some sort of compressible element to provide better sealing, engagement of the seal may tend to mechanically work against the latch or clasp member eventually leading to a deterioration of the locking mechanism and poor sealing.

SUMMARY OF THE INVENTION

It is an object of the present invention to provide a container for storing and dispensing products which features a substantially fluid-tight seal for preventing or inhibiting the loss of any volatile component(s) contained in the product and/or for preventing air, water vapor, microorganisms or other agents which might adversely affect the product from freely coming into contact therewith.

It is a particular object of the present invention to provide a container for storing a solid or semi-solid cosmetic product such as an ointment, pomade, loose or pressed powder, gel, and the like, under fluid-tight conditions.

It is another object of the present invention to provide a hinged cosmetic container such as a vanity case or compact which features an easy opening latch or clasp and a fluid-tight seal which effectively protects the contents of the container but which does not work against the latch or clasp.

It is still another object of the present invention to provide a cosmetic container possessing a fluid-tight sealing mechanism which remains effective until the cosmetic product is totally consumed.

These and other objects are realized by the container for storing and dispensing solid and semi-solid products of the present invention which comprises:

(a) a base member provided with a chamber for storing product;

(b) a cover member; and, (c) a laterally compressible sealing means disposed between a downwardly projecting rigid element associated with or forming part of the cover member and an upwardly projecting rigid element associated with or forming part of the base member or chamber, the sealing means extending continuously about the chamber such that when the base member is in closing engagement with the cover member, the downwardly and upwardly projecting rigid elements cooperate to subject the sealing means disposed therebetween to a substantially fluid-tight lateral compression.

The foregoing container is especially adapted for storing cosmetic products of the types previously mentioned. The sealing means is readily engaged and disengaged with the merest of effort.

Since the sealing means of the container of this invention does not work against any locking device which the container might feature, there is little, if any, chance that the container will be forced open by an unintentional release of the compression on the sealing means, such representing still another advantage over known cosmetic containers. Moreover, unlike the compressible sealing elements of known types of containers, e.g., the compressible packing material of the container shown in U.S. Pat. No. 2,033,295, the sealing means herein does not subject the locking device, e.g., a clasp, to any appreciable mechanical stress which would otherwise result in poorer locking, and with it, sealing, performance.

BRIEF DESCRIPTION OF THE DRAWINGS

The invention will be more fully understood by reference to the drawings in which.

DESCRIPTION OF THE PREFERRED EMBODIMENTS

Figure 1:
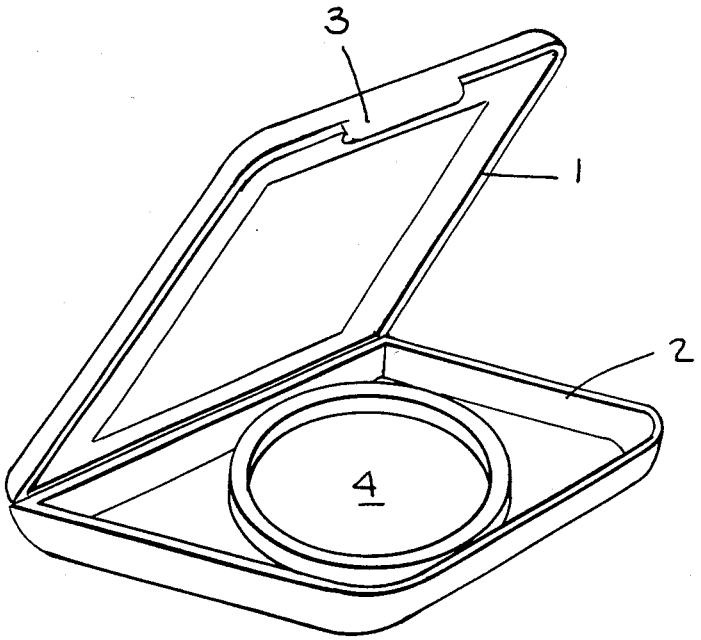
FIG. 1 is a perspective view of a known type of hinged cosmetic container having a chamber for storing product, a clasp or latch locking device and an optional mirror.
Figure 2:
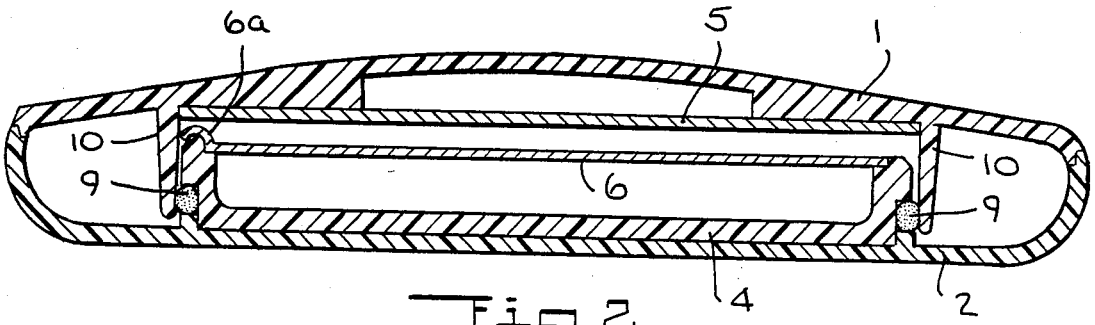
FIG. 2 is a cross-sectional view of a hinged cosmetic container having a latch and provided with primary and secondary sealing means in accordance with this invention. The base member is shown in closing engagement with the cover member and the secondary sealing means is shown under fluid-tight lateral compression.
Figure 3:
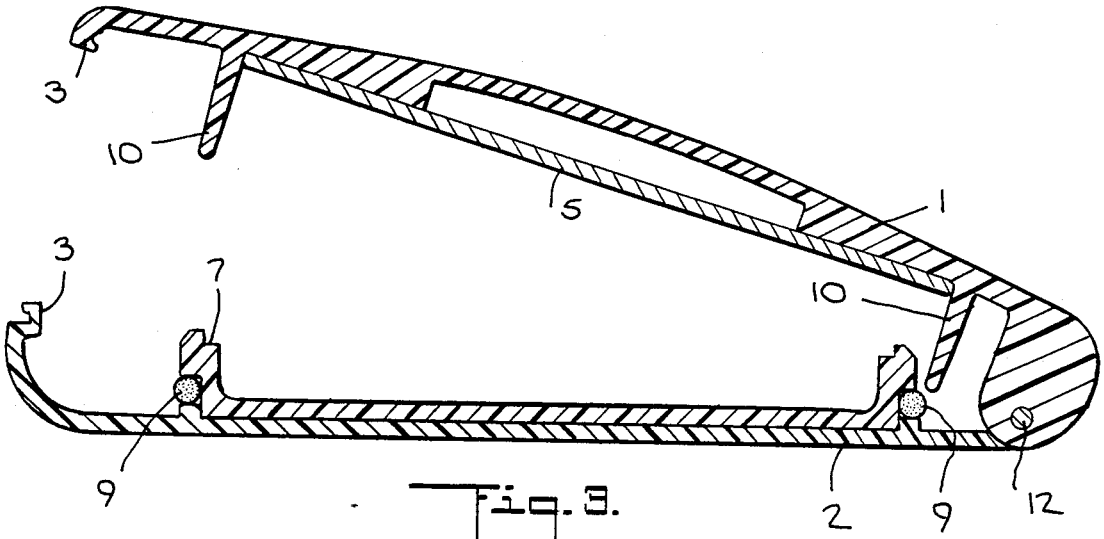
FIG. 3 is a cross-sectional view of the cosmetic container of FIG. 2 shown with the primary seal removed (as it would be after the customer has begun to use the product). The cross-section is taken across the hinge and latch with the base member and the cover member in an open position.
Figure 4:
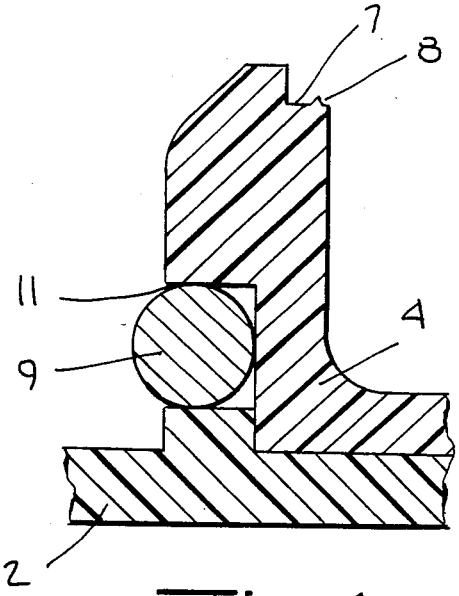
FIG. 4 is an enlarged cross-sectional view of the secondary sealing means of the open cosmetic container of FIG. 3.

In FIG. 1, there is shown a known type of hinged, rectangular cosmetic container having a cover member 1, a base member 2, a latch 3 and an interior circular chamber or reservoir 4 for storing a solid or semi-solid cosmetic product (not shown). FIGS. 2 to 4 are illustrative of a cosmetic container in accordance with this invention and additionally show a reflecting surface 5 which can be a glass mirror or metallized plastic bonded to cover member 1. It is contemplated that any of the materials heretofore employed in container construction can also be employed in the manufacture of the container herein. Such materials include a wide variety of synthetic resins, metals and combinations thereof. Conventionally, cosmetic cases are generally thermoplastic owing to the economics of raw materials and processing. Accordingly, styrenics, polyolefins, vinyls, polycarbonates and acrylics constitute the principally utilized resins. Again, with the low boiling ingredients which may be contained in the cosmetic preparation in mind, the material of construction for the chamber, if not the entire container, should be selected so as to resist chemical attack.

While a container featuring a hinge, e.g., mechanical hinge 12 or a hinge of the spring or flexible polymer variety, represents a preferred embodiment of the present invention, the cover member need not be permanently attached to the base member. Thus, the cover can be made to press-fit the base member or, given a circular configuration, can be made to threadably engage the latter. Similarly, although it is preferred to provide the container herein with a locking device such as mutually engaging elements 3 formed as part of the cover and base members, other designs can be used including the press-fit and threadably engaging types just mentioned.

In the cosmetic container of FIGS. 2–4, a cosmetic preparation (not shown) is stored in chamber 4 whose continuous rigid circular wall extends vertically upwardly from base member 2. Chamber 4 may be integrally formed as part of base member 2 or it can be fabricated as a separated element and bonded to base 2 as shown. Chamber 4 is optionally sealed at the factory (after having been previously filled with product) with a primary sealing means in the form of a discardable film barrier 6 optionally provided with tab 6*a* to facilitate its removal. The edge of film barrier 6 is attached to a flat boss 7 defined along the uppermost part of the chamber wall facing the interior thereof employing known and conventional techniques such as adhesive bonding or heat, ultrasonic or solvent welding. Flat boss 7 will contain a bead 8 as an energy director when ultrasonic welding is the method chosen. Film thickness is not critical and, in most cases, can range from 0.004 to 0.014 inches in thickness.

Film barrier 6 and tab 6*a* can be made from any of a wide variety of materials including paper and other cellulosic webs, transparent and opaque synthetic resins such as the polyolefins, polyvinychloride, polyvinylidene chloride polymers and copolymers, polyester, polystryrene, polycarbonate, acrylics, etc., and metals, principally aluminum. If desired, two or more of the foregoing materials can be formed into a laminate where a combination of barrier properties are desired. If a polymeric material is chosen for film barrier 6, it may be advantageous to select the same material for construction of chamber 4 in order to promote a good seal between the two. For example, when a laminate of aluminum upon high density polyethylene is chosen as the material for film barrier 6, it is preferred to employ the same high density polyethylene resin for fabricating chamber 4.

Once optional film barrier 6 is removed by the consumer, e.g., by being peeled away from flat boss 7, the sole remaining sealing element will be that of the laterally compressible sealing means of this invention. In the embodiment shown, said means is provided as a laterally compressible resilient gasket or O-ring 9 extending continuously about chamber 4 within a groove or channel 11 defined within the exterior wall of the chamber. The circumference of gasket or O-ring 9 is preferably somewhat smaller than the diameter of the chamber so that this element, being fabricated from an elastic or rubber-like material, will be held within groove 11 under elastic tension. As shown in FIG. 2, when cover member 1 is in the closed position, vertically downwardly projecting rigid member 10 which continuously extends about the vertically upwardly extending rigid wall of chamber 4 cooperates with the latter to cause an inwardly directed horizontal or lateral compressive force to be applied against gasket or O-ring 9 thereby providing a substantially fluid-tight seal. Other arrangements for positioning the sealing means can be provided; for example, the interior wall of rigid member 10 can be provided with a continuous groove or channel accommodating a gasket or O-ring adhesively bonded thereto. In the closed position, rigid member 10 and the rigid wall of chamber 4 will cooperate to cause an outwardly directed lateral compressive force to be applied against the gasket or O-ring again effecting a substantially fluid-tight seal.

The amount of compressive force exerted against gasket or O-ring 9 to achieve a fluid tight seal can vary widely and frequently will be on the order of from about fifteen to twenty percent lateral linear deformation. Gasket or O-ring 9 can be fabricated from a wide variety of elastic materials including natural and synthetic rubbers such as the silicone, neoprene, buna and ethylene-propylene dimer monomer (EPDM) rubbers, elastomeric resins such as the polyolefins and the polyurethanes.

All of the vectors of the sealing force acting upon gasket or O-ring 9 cause it to be compressed in the lateral direction; consequently there are no forces working against hinge pin 12 or class 3 which could cause the container to unintentionally spring open.

While one preferred embodiment of the invention has been disclosed in the foregoing drawings, it is to be understood that this disclosure is for the purpose of illustration only and that various changes in shape, proportion and arrangement of parts, as well as the substitution of equivalent elements and materials for those herein disclosed, can be made without departing from the spirit and scope of the invention as set forth in the appended claims.

What is claimed is:

1. A container for storing and dispensing a solid or semi-solid product containing at least one component which is relatively volatile and/or susceptible to chemical and/or microbial spoilage which comprises:

(a) a base member provided with a chamber for storing the product, said chamber having a rigid, continuous, upwardly projecting wall;

(b) a cover member connected to the base member by a hinge, said cover member having a rigid, continuous, downwardly projecting element extending continuously about the upwardly projecting wall of the chamber;

(c) locking means for maintaining the base member in closing relationship with the cover member; and, (d) a resilient, laterally compressible gasket or O-ring member extending about the exterior wall of the chamber within a peripheral groove or channel defined therein and positioned below the upper edge of the chamber wall, a substantially fluid-tight seal resulting when the base member, being in closing engagement with the cover member, causes the upwardly projecting rigid wall of the chamber to cooperate with the downwardly projecting rigid element or exert a lateral compressive force against the gasket or O-ring disposed therebetween.

2. The container of claim 10 wherein the gasket or O-ring is held within the groove or channel under elastic tension.

3. The container of claim 1 wherein the chamber is sealed with a removable barrier film.

4. The container of claim 3 wherein the barrier film is a laminate of metal on synthetic resin.

5. The container of claim 1 wherein the chamber for storing the product is integral with the base member.

6. The container of claim 1 wherein the chamber for storing the product is separate from the base member and is bonded thereto.

* * * * *